United States Patent [19]

Herpich

[11] 3,955,694

[45] *May 11, 1976

[54] SIDE LOADING REFUSE BODY

[75] Inventor: William A. Herpich, Galion, Ohio

[73] Assignee: Peabody Galion Corporation, Galion, Ohio

[ * ] Notice: The portion of the term of this patent subsequent to Nov. 25, 1992, has been disclaimed.

[22] Filed: June 18, 1975

[21] Appl. No.: 587,851

Related U.S. Application Data

[63] Continuation of Ser. No. 488,428, July 15, 1974, abandoned.

[52] U.S. Cl. ..... 214/82; 214/83.3; 100/190; 100/250

[51] Int. Cl.[2] ..... B65F 3/00

[58] Field of Search ..... 214/83.18, 83.2, 82, 214/83.3, 503; 100/190, 250

[56] References Cited

UNITED STATES PATENTS

| | | | |
|---|---|---|---|
| 2,816,797 | 12/1957 | Hanson | 214/83.2 X |
| 3,231,111 | 1/1966 | Clar | 214/83.3 |
| 3,584,755 | 6/1971 | Smith | 214/83.3 |
| 3,687,313 | 8/1972 | Smith | 214/83.3 |

*Primary Examiner*—Albert J. Makay
*Attorney, Agent, or Firm*—Henry K. Leonard

[57] ABSTRACT

A side loading refuse truck having a reciprocable ram in the bottom of a loading compartment at the front of the truck for pushing rubbish from the loading compartment through an opening therefrom at the bottom of the rear wall of the loading compartment into a larger rear body section. Hydraulic mechanism moves the ram in short strokes through the loading compartment for packing refuse rearwardly into the larger body section. The body has an openable rear wall. The hydraulic mechanism also can be actuated to move the ram rearwardly through the opening and along the bottom of the larger rear body section to the rear thereof for ejecting refuse from the larger body section. There is a vertical guide track up which at least the greater part of an articulated sliding shield extends when the ram is forward of or in the bottom of the loading compartment. The sliding shield is pulled along with the ram when it moves into and through the larger body section in order to prevent refuse from falling down in front of the ram as it moves backwardly. When the ram is moved forwardly to the loading compartment, the sliding shield moves back up the vertical track.

10 Claims, 17 Drawing Figures

FIG. 15
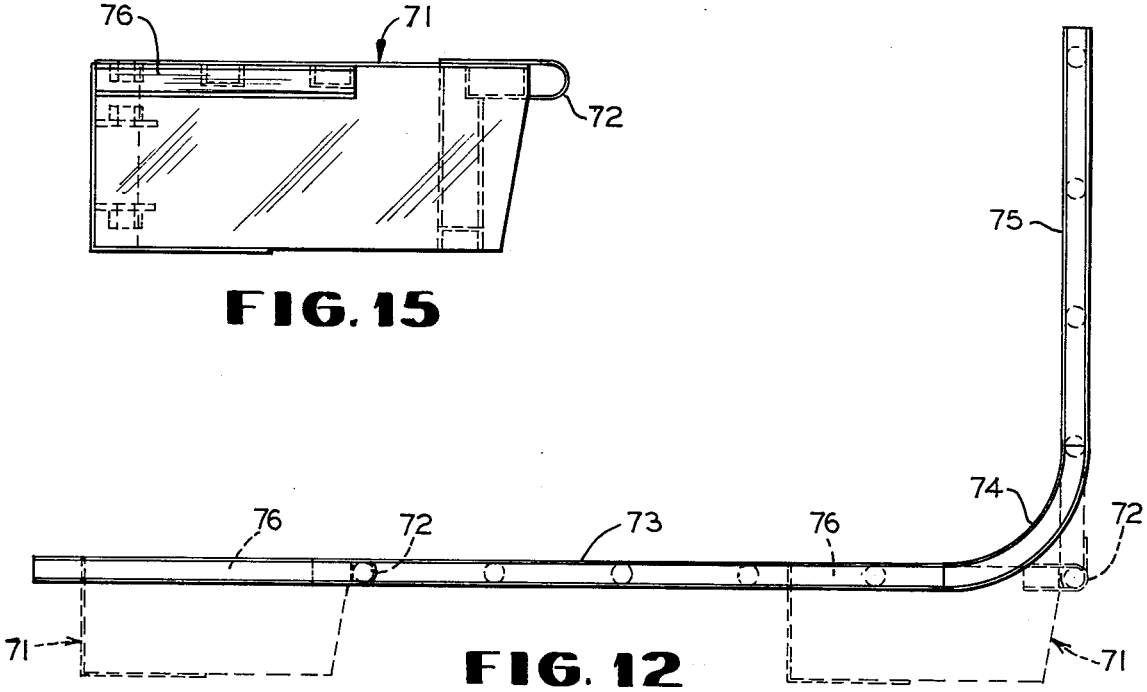
FIG. 12
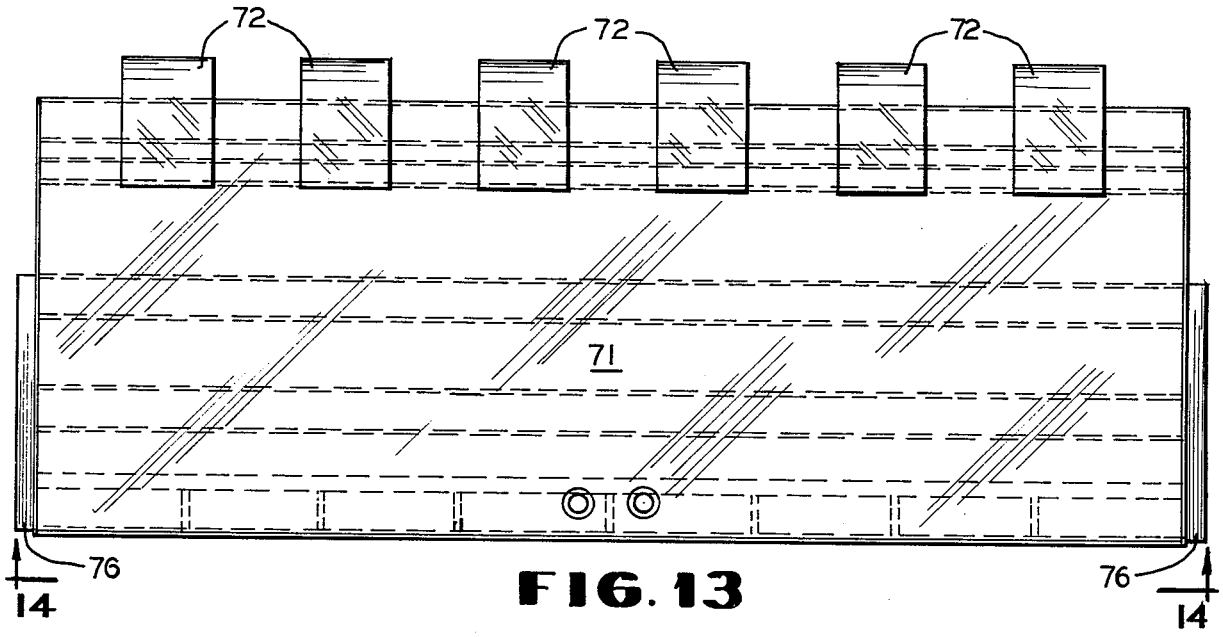
FIG. 13
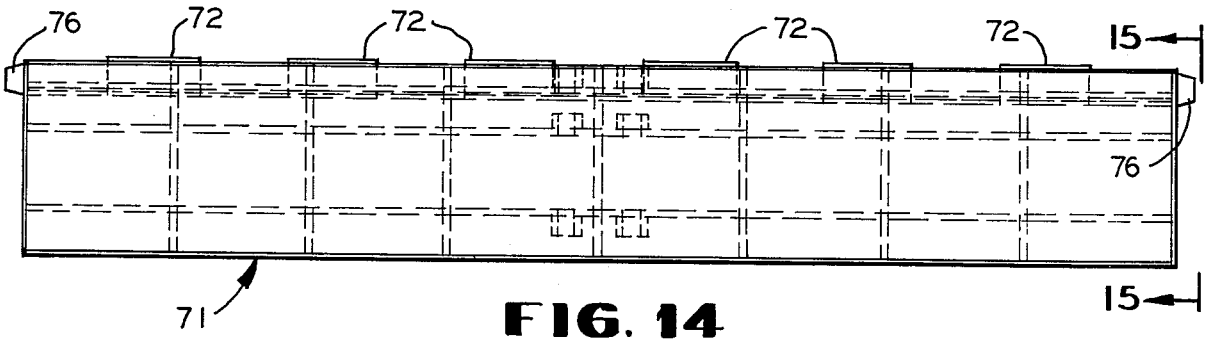
FIG. 14

SIDE LOADING REFUSE BODY

This is a continuation of application Ser. No. 488,428 filed July 15, 1974, now abandoned.

BACKGROUND OF THE INVENTION

This invention relates to side loading refuse trucks and, more particularly, to a side loading refuse truck which has a loading compartment at one end, usually immediately behind the truck cab, into which refuse is dumped from portable containers such as domestic trash cans, and which has mechanism for packing the refuse from the loading compartment into a main rear portion of the truck body.

Refuse trucks of this type may be generally divided into two classes. First, there is the type which comprises a reciprocating ram movable through the bottom of the loading compartment for packing refuse from the loading compartment into the rear storage portion of the body. When the body is fully loaded it is tilted upwardly to dump the refuse out of the body. Such trucks are shown, for examples, in U.S. Patents to Ochsner No. 2,076,504; to Balbi No. 2,487,411; to Huffines No. 2,750,055. In a second type of side loading refuse vehicle, the refuse is emptied into a loading compartment from the side and packed into the body of the vehicle by a ram movable through an opening defined beneath the lower end of a moveable upper partition wall. After the body is loaded with refuse, the packing ram is moved with movable partition to the rear of the vehicle, the two acting as a single ejector plate for discharging refuse from the body without the requirement that the body be tilted for emptying the refuse. Examples of this second type of vehicle are shown in U.S. Pats. to Brison Patents 3,252,600 and Churchman No. 3,802,585.

In both of these systems it is necessary not only to have power means such as hydraulic cylinders for actuating the packing ram which moves through the loading compartment but also, in the first system, to have mechanical means for tilting the body to dump refuse therefrom and, in the second system, to have either a separate, a second set of hydraulic cylinders or similar means for moving the main ejection plate, or to provide complex mechanisms for coupling the movement of the ejection plate and the ram as a unit through the body in order to eject refuse therefrom.

It is therefore the principal object of this invention to provide a side loading refuse truck having a loading compartment at its forward end and a ram which reciprocates across the bottom of the loading compartment to pack refuse loaded therein through an opening into a larger, rear storage body where it is accumulated and the ram also may be reciprocated through the larger storage body for the ejection of refuse therefrom after the body is filled.

It is yet another object of the instant invention to provide a side loading refuse truck having a simple low profile ram which functions both for packing refuse from a loading compartment into a storage body and for ejecting refuse from the storage body when the body is filled.

And yet another object of the instant invention is to provide a side loading refuse truck having a single, low profile ram which is reciprocated automatically through a loading compartment for packing refuse therefrom into a storage body at the rear of the truck and through the storage body itself for the ejection of refuse and which has associated with the ram a traveling articulated shield which closes off the space in front of the ram both during its packing cycle and during its ejection cycle in order to prevent refuse from falling downwardly into the bottom of either the loading compartment or the storage body in front of the ram.

These and more specific objects and advantages of a side loading refuse truck embodying the invention will become apparent from the sepcification which follows, and from the drawings appended hereto.

BRIEF DESCRIPTION OF THE DRAWINGS

FIG. 12 is a simplified, longitudinal, vertical sectional view showing the articulated shield and its track in the truck of FIG. 10;

FIG. 13 is a detailed plan view of the ram employed in the truck of FIG. 10;

FIG. 14 is a view in elevation of the ram of FIG. 13 taken from the position indicated by the line 14—14 of FIG. 12; FIG. 15 is a view in end elevation taken from the position indicated by the line 15—15 of FIG. 14;

DESCRIPTION OF PREFERRED EMBODIMENT

Figure 1:
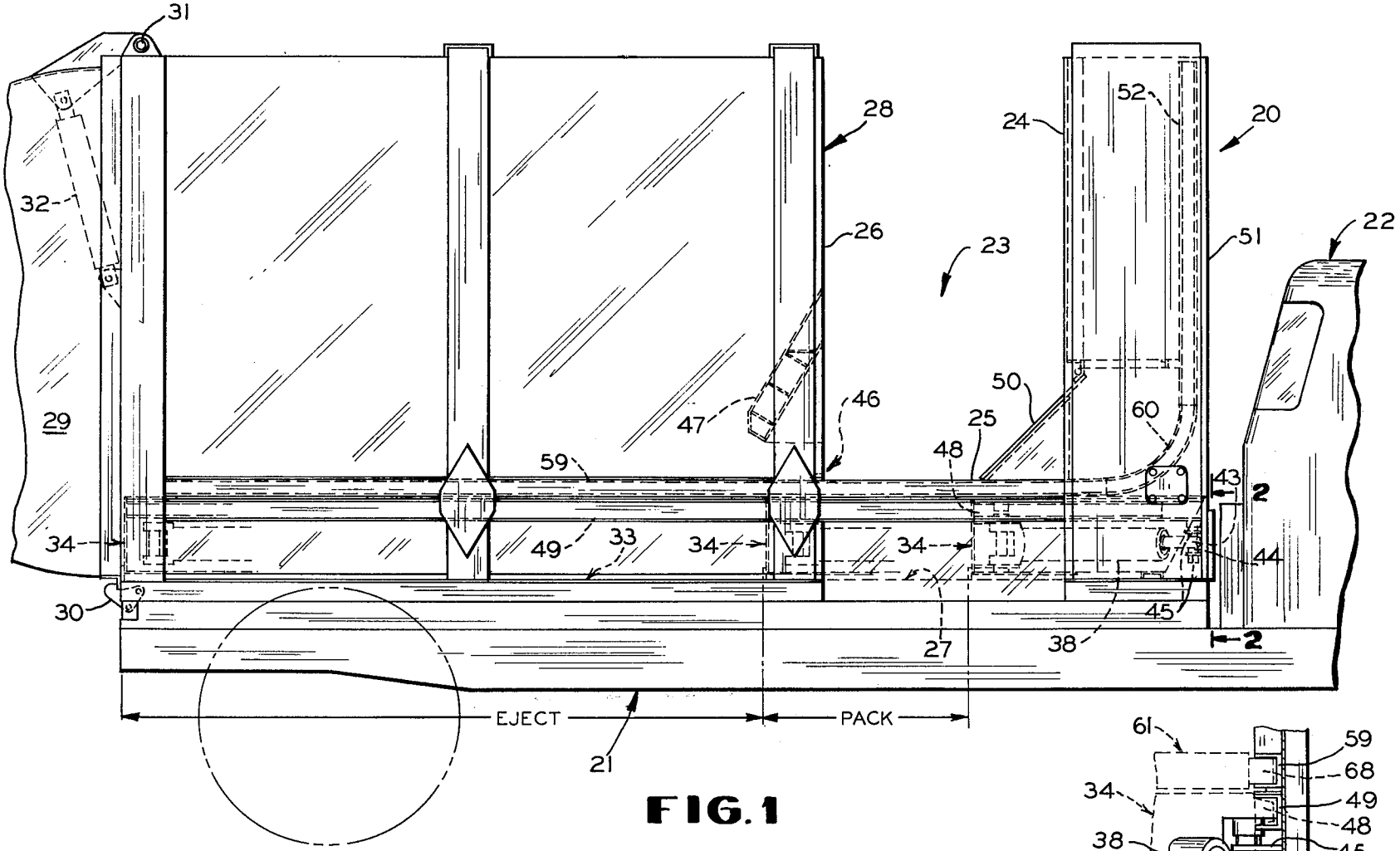
FIG. 1 is a fragmentary view in side elevation of a refuse truck embodying the invention.

A refuse truck embodying the invention has a body, generally indicated by the reference number 20, which is mountable on a truck chassis 21 located at the rear of a cab fragmentarily indicated by the reference number 22. The body 20 comprises a loading compartment 23 which is defined by a front vertical wall 24, short side walls 25, a partition wall 26 and a floor 27. The partition wall 26 also serves as a front wall of a generally rectangular refuse storage body or receiving chamber generally indicated by the reference number 28. The receiving chamber 28 has an openable rear wall or tailgate 29 normally held in closed position across the rear end of the chamber 28 by suitable latching mechanism 30. When it is desired to eject refuse from the storage chamber 28, the tail gate 29 is swung upwardly and rearwardly around its top pivots 31 by a pair of hydraulic cylinders 32 located one on each side of the body 20.

Figure 5:
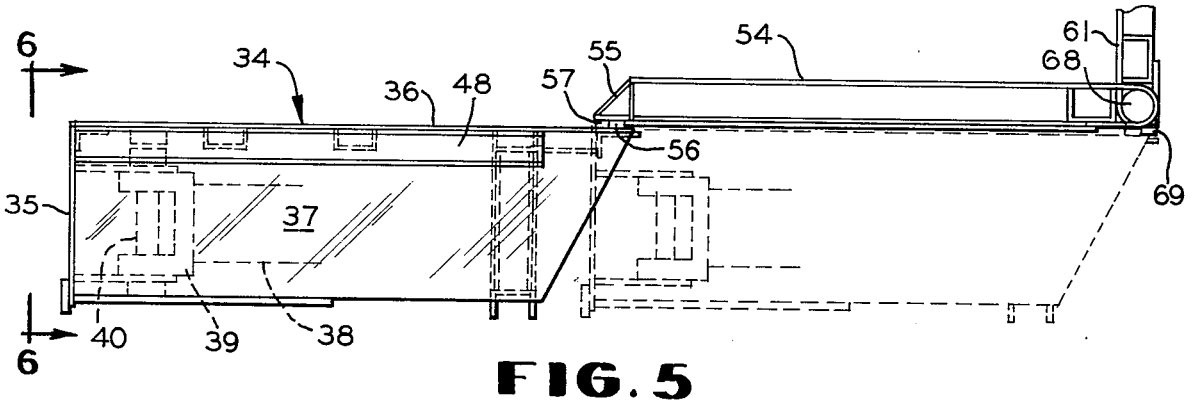
FIG. 5 is a fragmentary detailed view partly in elevation illustrating the packing cycle of the ram.
Figure 6:
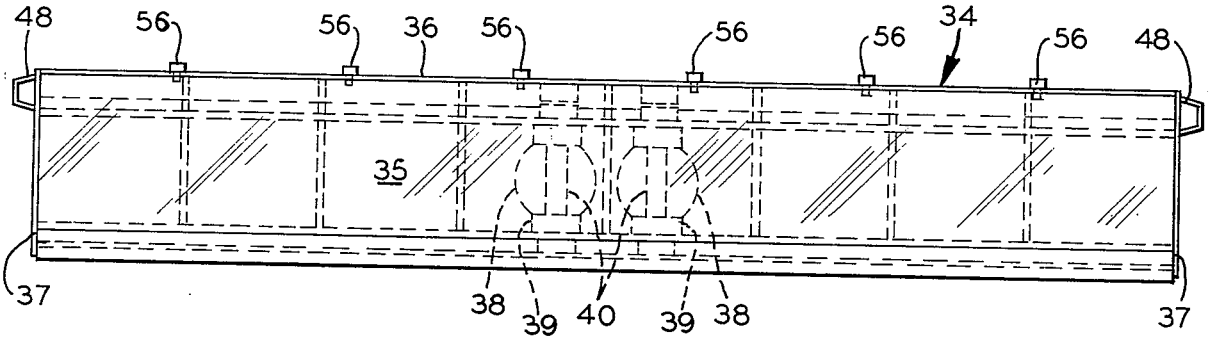
FIG. 6 is a view in elevation taken from the position indicated by the line 6—6 of FIG. 5.

The floor 27 of the loading compartment 23 lies in the same horizontal plane as a floor 33 of the storage body or chamber 28. A ram, generally indicated by the reference number 34 and shown in detail in FIGS. 5 and 6, has a vertical front face 35 which extends transversely across the truck, a horizontal flat top 36, and vertical side plates 37 which give it a box-like configuration with a hollow interior.

Figure 2:
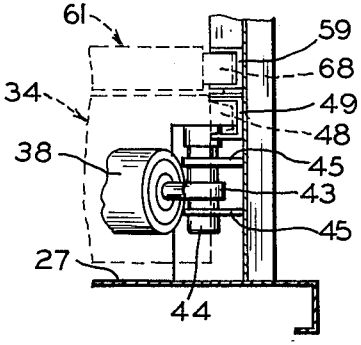
FIG. 2 is a fragmentary, vertical sectional view taken along the line 2—2 of FIG. 1 and shown on an enlarged scale.
Figure 4:
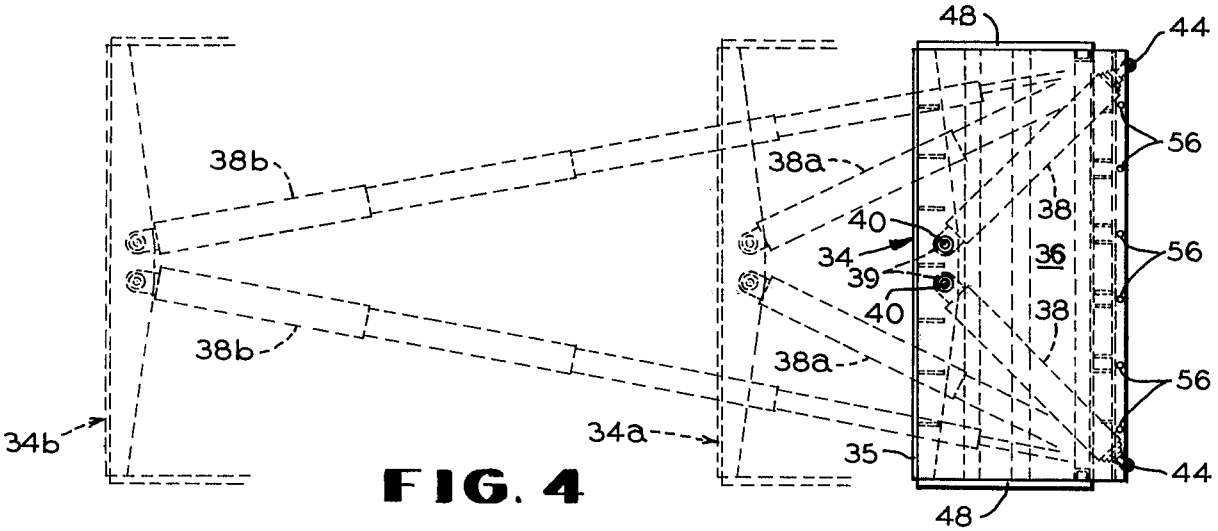
FIG. 4 is a horizontal sectional view taken along the line 4—4 of FIG. 3 and shown on a reduced scale.

The ram 34 is reciprocated either in its packing strokes to and fro along the bottom of the loading compartment 23 or, in a longer excursion, to the rear of the storage body 28 by a pair of hydraulic cylinders 38, more clearly shown in FIG. 4. Each of the hydraulic cylinders 38 is pivotally connected at its rear end by a clevis 39 on a heavy vertical pin 40 which is mounted in suitable collars 41, one on the underside of the ram top 36 and the other on a bottom plate 42 of the ram 34. The piston ends of the hydraulic cylinders 38 are similarly pivotally connected by ears 43 (FIG. 2) through which extend vertical pins 44 that are in turn carried by brackets 45 fixed to a stationary cross beam of the body 20. The hydraulic cylinders 38 are conventional telescoping cylinders, usually of three stages, so that they can be extended from their retracted position shown in solid lines at the right of FIG. 4, first to their intermediate position, indicated by the reference number 34*a* in FIG. 4 for actuating the ram 34 to pack refuse from the loading compartment 23 into the storage body 28 and, secondly, to their fully extended positions, indicated by the reference number 34*b* to move the ram 34 all the way to the rear of the storage body 28 when it is desired to eject refuse therefrom.

PACKING CYCLE

During the loading of refuse into the truck, the refuse crew empties portable containers such as household trash cans, over the sidewalls 25 into the loading compartment 23 from either side of the vehicle. Refuse thus emptied into the loading compartment 23 falls downwardly onto the floor 27 and the hydraulic cyliners 38 are actuaed to extend from their retracted position shown in actuated 1 and 3 rearwardly to move the ram 34 to its intermediate position 34*a* (FIGS. 3 and 4) to pack the refuse through an opening generally indicated by the reference number 46 which is defined by the lower edge of the partition wall 26, the bottom 27 of the loading compartment 23 and its side walls 25. A heavy breaker bar 47 extends downwardly at the rear of the opening 46 and terminates at a level slightly above the top of the front face 35 of the ram 34, to provide a strong edge against which the ram 34 can break objects such as sticks, perhaps even 2 × 4 inch lumber, and the like.

The ram 34 is guided during its reciprocation through the bottom of the loading compartment 23 by a pair of horizontal slides 48 one at each side of the ram 34 which slide in horizontal guides 49. The guides 49 are inwardly turned, U-channels which extend all the way from the front of the body 20 (at the right of FIG. 3) almost to the rear of the storage body 28, one at each side. An inclined deflector plate 50 at the forward part of the loading compartment 23, just above the level of the top 36 of the ram 34, deflects refuse rearwardly into the bottom of the loading compartment 23. The space beneath the deflector plate 50 and forwardly and beneath the front wall 24 of the loading compartment 23, is defined at its front side by a front wall 51 of the body 20, this space being hollow and serving as a compartment for the ram 34 at its foremost position, as well as enclosing the hydraulic mechanism graphically illustrated in FIG. 17. Vertically extending guides 52 for an articulated shield, generally indicated by the reference number 53 (FIG. 3) are located between the loading compartment wall 24 and the front body wall 51. The shield is actuated by the ram 34, during the movement of the ram 34 from its intermediate position 34*a* to its rear position 34*b* (FIG. 3).

Figure 3:
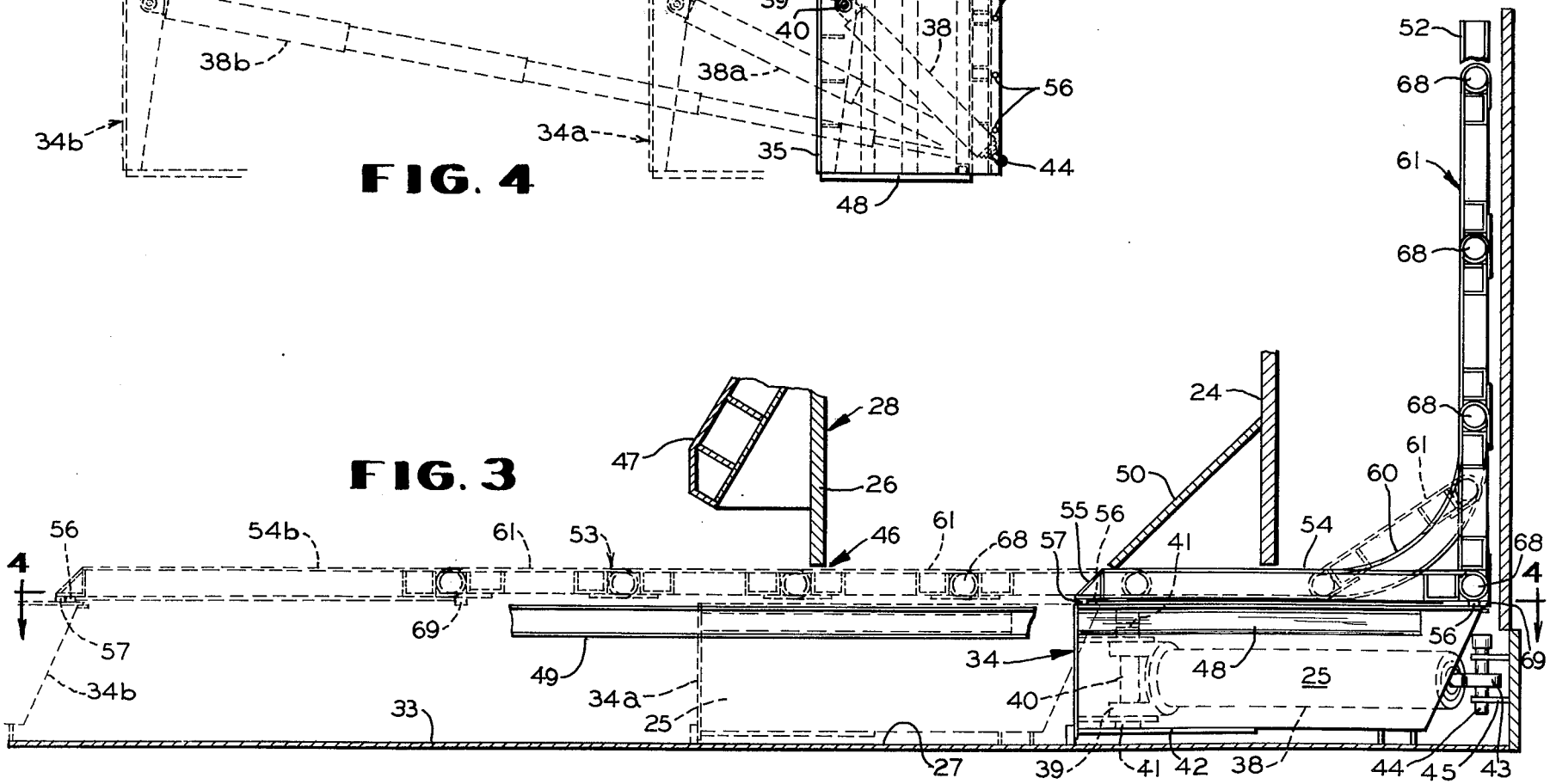
FIG. 3 is a longitudinal, vertical sectional view of the truck shown in FIG. 1, particularly illustrating the articulated sliding shield, the packing cycle of the ram and the guide trades for the shield.

In this embodiment of the invention, the articulated shield 53 comprises a horizonal cover 54 which has an inclined front edge 55 lying as an extension of the deflector plate 50 in its normal or rest position illustrated in solid lines in FIG. 3. Because of a "lost-motion" connection between the ram 34 and the horizontal cover 54 to be decribed below, the cover 54 remains in its rest position while the ram 34 is cycled between its forward position 34 and its intermediate positions 34*a*, i.e., during the packing of refuse from the bottom of the loading compartment 23 through the opening 46 into the storage body 28. Because the top 36 of the ram 34 is a solid plate, when the ram 34 reciprocates between its forward (solid line) position to its intermediate (dotted line) position, any refuse in the loading compartment 23 which is above the level of the top edge of the ram face 35, is supported on the ram top 36 and does not fall down in front of the ram 34. The deflector plate 50 overlies the front edge of the ram 34 in this intermediate position of the ram 34.

Thus the ram 34 can be reciprocated automatically between its forward and intermediate positions and the operators may continue to dump refuse into the loading compartment 23 whether the ram 34 is in its forward position or in its intermediate position. Upon each reciprocation of the ram 34 to its forward position, any refuse in the loading compartment 23 drops down to the floor 27 and is thrust through the opening 46 upon the next rearward movement of the ram 34.

Figure 16:
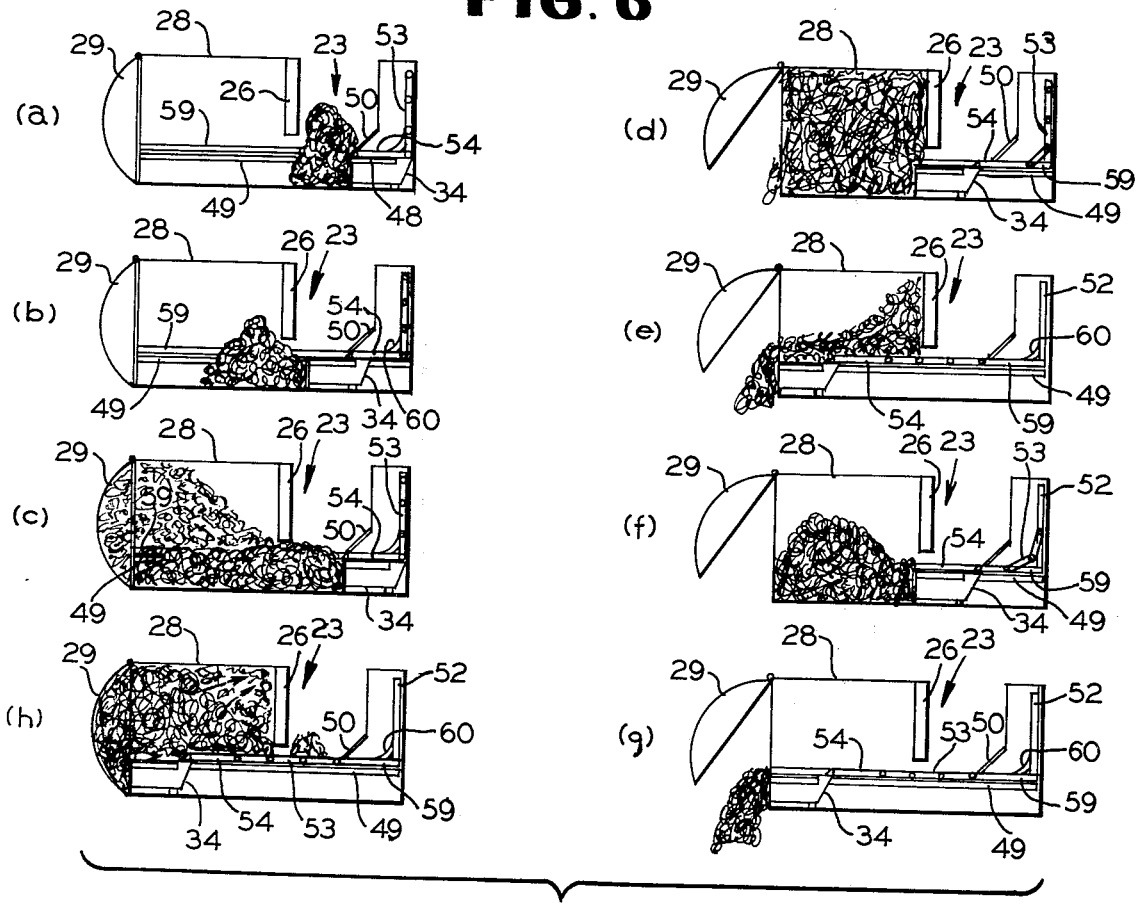
FIG. 16 comprises a series of eight reduced scale sketches illustrating the packing and ejection strokes of the ram of a refuse truck embodying the invention.

The packing cycle is diagramatically illustrated in sketches (a), (b) and (c) of FIG. 16. In sketch (a) the ram 34 is shown in its front position beneath the deflector plate 50 and refuse is shown as having been emptied downwardly into the loading compartment 23. The cylinders 38 are then energized to move the ram 34 to its intermediate position as shown in sketch (b). Repeated reciprocating strokes of the ram 34 between the positions shown in sketches (a) and (b) gradually transfers successive charges of refuse into the storage body 28 until the body is substantially filled as illustrated in the sketch (c) of FIG. 16. As will be described below, the ram 34 may be moved under control of the operators to its rear position before the body is filled in order to compact the refuse in the body and achieve a full load.

EJECTION CYCLE

After a sufficient number of packing cycles have been completed to fill the storage body 28, the truck is driven to a discharging location such as the city dump or incinerator. The operator disengages the latching mechanism 30 and actuates the hydraulic controls to power the tail gate cylinders 32 in order to swing the tailgate 29 upwardly and rearwardly so that refuse can be discharged from the truck. He then manipulates the hydraulic control mechanism (to be later described) to energize the ram cylinders 38 to move the ram 34 to its rear position (left in FIG. 3). As mentioned above, the cover 54 is not moved during packing but when the ram 34 moves rearwardly beyond its intermedite position 34*a*, a transversely extending series of pins 56, which are studded into the trailing edge of the ram top 36, engages a cross bar 57 located beneath the front edge 55 of the cover 54. This engagement constitues the end of the "lost motion". As the ram 34 continues to move rearwardly from its intermediate position toward the rear of the storage body 28, it pulls the horizontal cover 54 along behind it, sliding the cover 54 out from beneath the lower edge of the deflector plate 50 and across the loading compartment 23.

Figure 7:
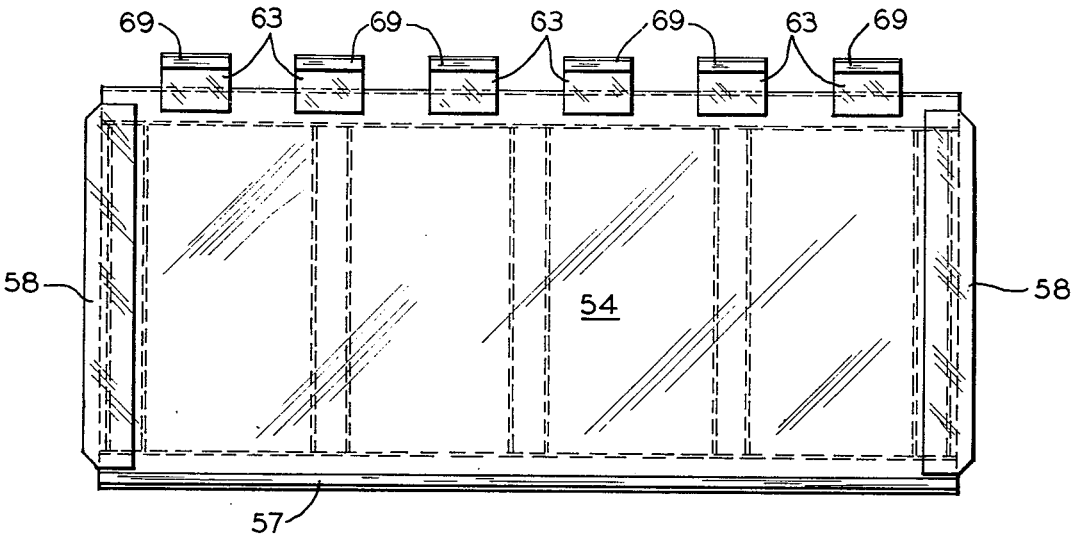
FIG. 7 is a bottom plan view of a sliding cover plate which is connected to the sliding shield and moved by the ram.

The cover 54 has a pair of edge guides 58 (FIG. 7) which slide in horizontal guides 59 (FIG. 2) extending along above the ram guides 49. The front ends of the horizontal cover guides 59 are connected by short arcuate guide sections 60 (FIG. 3) to the verticle shield guides 52 at the front of the vehicle.

ARTICULATED SHIELD

Figure 8:
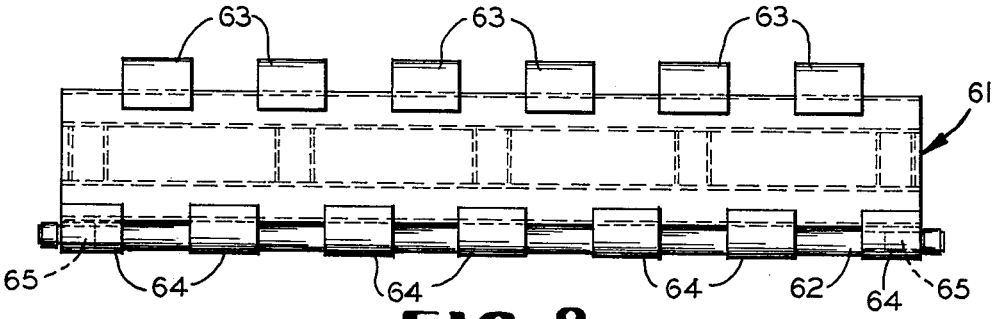
FIG. 8 is a bottom plan view of one element of the articulated sliding shield.

The articulated shield 53 comprises not only the cover 54 but also several individual hinged sections 61 (FIGS. 8 and 9) which are connected to each other and to the cover 54.

Figure 9:
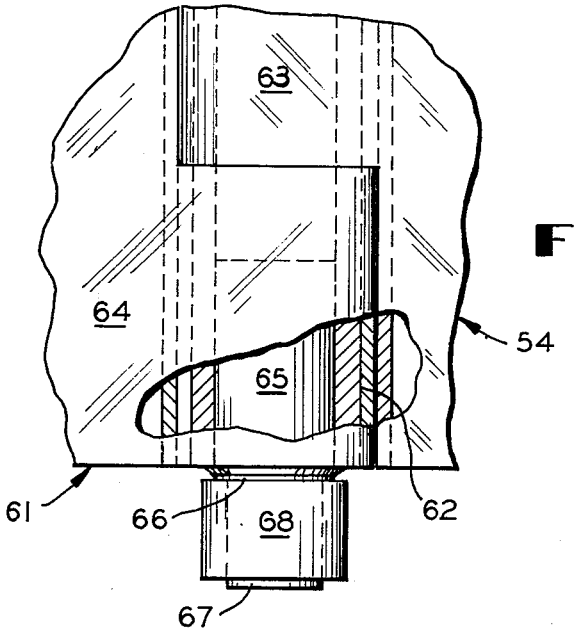
FIG. 9 is a fragmentary, enlarged plan view of the hinge elements of the articulated shield, with parts broken away.
Figure 11:
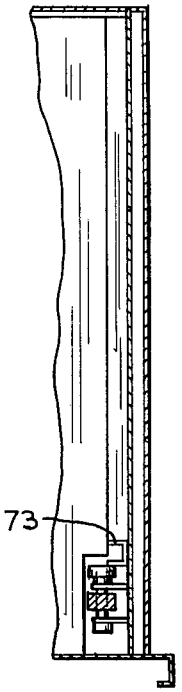
FIG. 11 is a fragmentary, vertical sectional view taken along the line 11—11 of FIG. 9.
Figure 10:
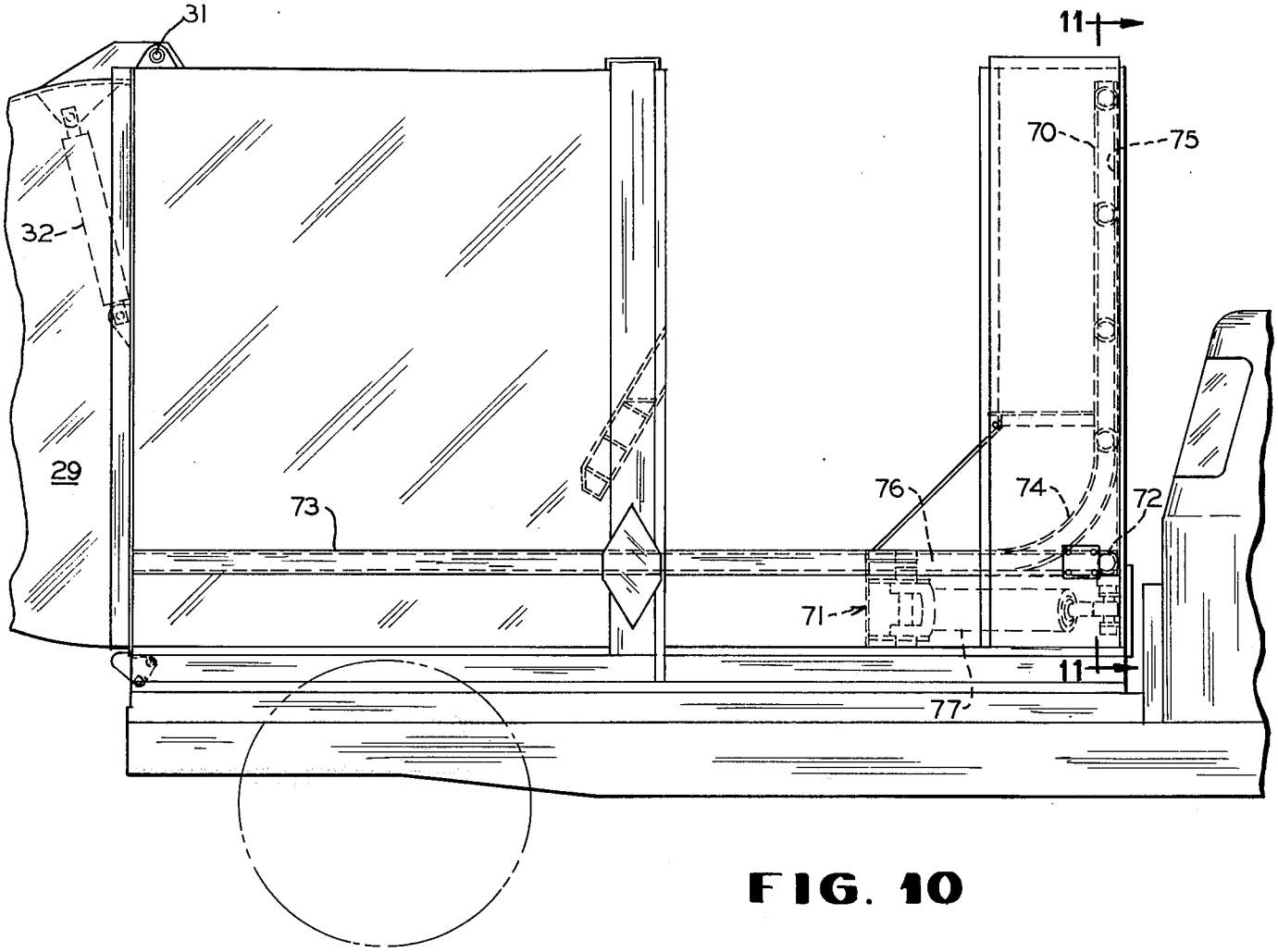
FIG. 10 is a view similar to FIG. 1 but illustrating a truck embodying a modification of the invention.

The first of the hinged sections 61 is connected to the trailing edge of the cover 54 and each of the successive sections 61 is connected to the preceding section 61 by a hinge tube 62. Each of the hinge tubes 62 extends through spaced, alternating ears 63–64 located, respectively, on the trailing edge of the top 54 or a hinge section 61 and the leading edge of a following hinge section 61. The ears 63 and 64 are interdigitated during assembly so as to align with each other horizontally and transversely of the body 20 and the tubes 62 are thrust through the aligned ears 63 and 64 in the manner of piano hinge pins. A short rod 65 is inserted in each open end of each of the tubes 62 and welded into place in its respective tube end by a ring weld around its shoulder 66 (FIG. 9). The outer end of each of the rods 64 has a turned down tenon 67 onto which there is slid an annular bushing 68. The bushings 68 roll along in the horizontal shield guides 59, the arcuate guide sections 60 and the verticle shield guides 52, as the articulated shield 53 follows along behind the cover 54 and the ram 34 during the movement of the ram 34 to its rear position for the ejection of refuse from the storage body 28.

As can best be seen in FIG. 3, the articulated shield 53 passes closely beneath the lower edge of the partition wall 26 and the deflector plate 50, closing off the bottom of the loading compartment 23 and sliding along with the ram 34 to provide a surface beneath refuse in the storage body 28 which is located above the level of the front face 35 of the ram 34 as the ram 34 moves toward the rear of the body 28.

Referring again to FIG. 16 and the sketches (d), (e), (f) and (g) thereof, the ejection cycle thus far described is illustrated in sketches (d) and (e) which show the ram 34 moving from its intermediate position in sketch (d) to the rear of the storage body 28 in sketch (e). These two sketches illustrate how the ram 34, pulling the articulated shield 53 along with it, ejects a mass of refuse approximately of the height of the face 35 of the ram 34 out of the then open rear of the body 28 as it reaches the rear of the body 28, as shown in sketch (e) of FIG. 16.

The operator then reverses the hydraulic controls to the ram cylinders 38 causing the ram 34 to move forwardly in the body back to its intermediate position, as shown in the sketch (f) of FIG. 16 so that refuse falls down behind the ram 34 as the ram 34 retracts forwardly and the shield 53 is slid at least partially up the verticle shield guides 52.

When the ram 34 reaches the position shown in sketch (f) of FIG. 16, the operator reverses the hydraulic connections to the ram cylinders 38, and once again the cylinders 38 extend to move the ram 34 to the back of the body 28 as shown in the sketch (g) of FIG. 16 to eject another quantity of refuse shown as having fallen down behind the ram 34 in the sketch (f). This reciprocation of the ram 34 through the bottom portion of the storage body 28 is repeated a sufficient number of times to result in ejecting serially all of the "layers" of refuse which has been accumulated in the storage body 28. In practice it has been found that by reason of the entanglements and compaction of the refuse in the storage body 28 resulting from the repeated packings cycle as shown in sketches (a), (b) and (c) of FIG. 16, a very large portion of the refuse is ejected on the first stroke of the ram 34 to the rear of the body 28. Usually all of the refuse is ejected after only two or, at the most, three such strokes.

The "lost-motion" connection between the ram 34 and the horizontal cover 54 which has already been mentioned with respect to the fact that the cover 54 remains stationary during the packing cycles of the ram 34, results in the cover 54 and the connected hinge section 61 remaining stationary in their rearmost positions when the ram 34 starts to move toward the front of the truck. When the ram 34 reaches a position relative to the cover 54, as shown in dotted lines in FIG. 5, the pins 56 engage a series of stops 69 located on the undersides of the hinge leaves 63 so that further movement of the ram 34 forwardly pushes the cover 54 and the remainder of the articulted shield 53 forwardly along the horizontal shield guide 59, around the arcuate guide sections 60 and up the verticle shield guides 52 until the cover 54 is once more restored to its rest position as shown in solid lines at the right of FIG. 3.

A modified form of refuse truck embodying the invention is illustrated in FIGS. 10–15 inclusive. In this embodiment of the invention an articulated shield generally indicated by the reference number 70 is permanently connected to a sliding ram 71 shown in plan in FIG. 13, in front elevation in FIG. 14 and in end elevation in FIG. 15. The ram 71 is substantially identical to the ram 34 of the earlier described embodiment of the invention with the exception that a series of spaced hinge ears 72 (FIGS. 13 and 15) are mounted at the front or trailing edge of the ram 71 and are connected permanently to interdigitated ears (not shown) on the first of a plurality of elements of the articulted shield 70. The connection between the ears 72 of the ram 71 and the leading element of the shield 70 is made in the same fashion as that already described for connecting the cover 54 to the articulated shield 53 of the earlier described embodiment.

In the embodiment of FIGS. 10–15, inclusive, there is only one set of guides including a horizontal portion 73, an arcuate portion 74 and a vertical portion 75. The ram 71 has end slides 76 which also slide in the horizontal portion 73 of the guides.

As in the earlier described embodiment of the invention, the ram 71 is moved by a pair of telescoping ram cylinders 77 connected to the ram 71 and to the body 20 in the same fashion as the cylinders 38 are connected.

Thus the only difference between the embodiment of the invention illustrated in FIGS. 10–15 inclusive and the earlier described embodiment is that in the second embodiment the articulated shield 70 reciprocates in guides both during the packing cycle and during the ejection cycle.

The sequence of operations constituting an ejection cycle as described above may also be utilized prior to the time when the vehicle is driven to the dump or incinerator in order to insure that the storage body 28 is filled with refuse, particularly the upper front corner of the body 28. It will be observed in FIG. 1, where the tailgate 29 is only fragmentarily shown, and more easily in FIGS. 10 and 16, that a tailgate 29 for a refuse truck embodying the invention has a segmental longitudinal cross-section, bulging toward the rear to provide a curved pathway upwardly from the bottom of the body 28 toward its top. From time to time during the packing of refuse into the body 28, the operators may energize the hydraulic controls to transverse the ram all the way to the back of the body 28 with the tailgate 29 still in its closed position. The force exerted by the ram 34 along the bottom of the body 28 pushes refuse up and around the arcuate interior surface of the tailgate 29 tending thus to urge it over the top of previously packed and settled refuse already in the body 28, moving the refuse along the arcuate path diagramatically illustrated in the sketch (h) of FIG. 16. This extension of the ram 34 to the rear of the body 28 or part way toward the rear of the body 28 may be repeated as often as necessary during the loading of the storage body 28 until such time as the body is filled and compacted by the ram 34 to a degree deemed appropriate by the operators. It has been found that this utilization of the ram actuation in the "ejection" cycle during packing results in filling the body 28 to a degree greater than could be achieved without the circulatory movement of the refuse resulting from the actuation of the ram 34 toward the rear of the body 28 with the tailgate 29 in its closed position.

HYDRAULIC CONTROLS

Figure 17:
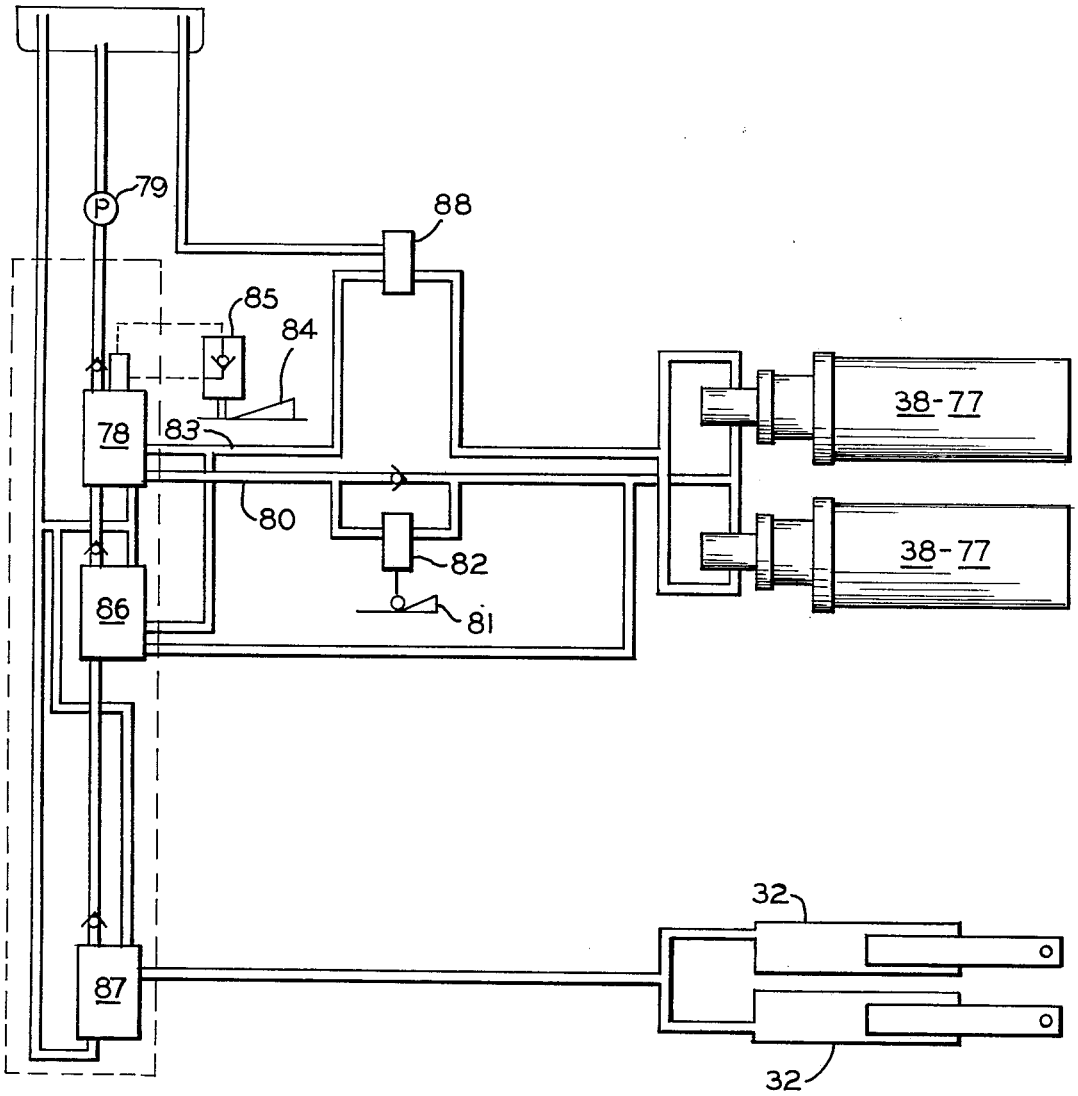
FIG. 17 is a schematic hydraulic circuit for the control of the ram in the strokes illustrated in FIG. 16.

The hydraulic circuit schematically illustrated in FIG. 17 is designed to provide for automatic cycling of the respective ram 34 or 71 during the packing cycles and manually controlled movements of the respective ram 34 or 71 during the ejection cycles. The same circuitry is employed in both embodiments of the invention and, therefore, the packing and ejecting ram cylinders are indicated by both reference numbers, i.e., 38 and 77. The two cylinders 38—38 or 77—77 are connected in parallel and are identically energized. The hydraulic actuating mechanism includes a main automatic cycle valve 78 which has a manual handle by which the valve 78 is moved into "extend" position. In this position the valve 78 connects a source of hydraulic fluid from a pump 79 through the valve 78 to an "extend" line 80 and thence to the two cylinders 38—38 or 77—77 to extend the cylinders, feeding the ram 34 or 71 rearwardly through the loading compartment to its intermediate position, i.e., with its front face 35 extending just into the storage body 28. At this point in the cycle a cam 81 (FIG. 17) mounted on the ram, engages the roller of a spring urged valve 82 which closes the "extend" line 80. Pressure immediately builds up in the line 80 and in the valve 78 and shifts the valve 78 to "retract" position. This feeds the hydraulic fluid under pressure to a "retract" line 83. The ram 34 or 71 then moves to the front of the truck until it reaches its foremost position when a second cam 84 carried by the ram actuates a reversing valve 85. When the valve 85 is opened, the pressure drop shifts the valve 78 to either of two positions depending upon the selected properties of the valve 78. If it is desired to accomplish only a single cycle and to require actuation of the valve 78 to accomplish each packing cycle, the the valve 78 is so designed that when the valve 85 is opened, the valve 78 returns to neutral. On the other hand, if it is desired that the ram 34 or 71 shall cycle automatically from front to back continuously in the packing cycle, the valve 78 is so designed that when the valve 85 opens, pressure shifts the valve 78 to "extend" position once again to move the ram 34 or 71 backwardly through the loading compartment. If the valve 78 is designed to be shifted to "extend" when the ram 34 or 71 reaches its foremost position, the ram cycles automatically back and forth to the bottom of the loading compartment continuously until valve 78 is shifted by hand to a "neutral" position. Such automatic packing cycles may be desirable when the truck is utilized uner conditions where operators are continuously dumping refuse into the loading compartment.

A manually operable valve 86 is shiftable between two alternate positions. With the automatic valve 78 in "neutral", the valve 86 is moved to feed hydraulic fluid to the "extend" line and to the cylinders 38 or 77 for extending the cylinders and moving the ram 34 or 71 rearwardly. The valve 86 can also be manually shifted to a "retract" position for feeding hydraulic fluid to the retract line 83 for moving the ram forwardly. The valve 86 is utilized by the operator in order to move the ram 34 or 71 through the body 28 in order to compact refuse in or to eject refuse from the body 28. The operator first moves the valve 86 to an "extend": position, and, when the ram 34 or 71 reaches the rear of the storage body 28, he reverses the valve 86 to move the ram fowardly into the loading compartment. He then reverses the valve 86 again to move the ram backwardly, etc., until the refuse is sufficiently compacted in or is ejected from the body 28.

A third valve 87 is manually actuated by the operator in order to feed fluid to the tailgate cylinders 32 for opening the tailgate prior to the time when he actuates the ram valve 86 for ejecting refuse in the manner just described. The hydraulic system also includes a flow control valve 88 which can be adjusted to give a controlled rate of flow to the retract line 83 and to the cylinders 38 or 77 to control the speed of movement of the ram forwardly in the body.

Having described my invention, I claim:

1. In a side loading refuse truck having a loading compartment, a larger refuse receiving body adjacent the compartment and rearwardly thereof, a floor for the compartment and a floor for the receiving body that lie in the same horizontal plane, an opening between the compartment and the body that is defined by a partition extending downwardly to a level spaced above the floor of said compartment and said body, and a low profile ram for pushing refuse from the bottom of the loading compartment into the receiving body, the improvement comprising, in combination, a. horizontal guides for said ram extending from forward of said loading compartment to the rear of said receiving body for guiding said ram along said floors from a front position forward of said loading compartment to an intermediate position with its rear face closing said opening and to a rear position at the rear of said receiving body for ejecting refuse therefrom, b. hydraulic mechanism for alternatively reciprocating said ram through said compartment and through said receiving body, c. a shield comprising a plurality of articulated members and having a length sufficient to extend from the front of said compartment to the front of said ram when said ram is in its rear position, and d. vertically extending shield guides at the front of said compartment for receiving said shield when said ram is at its front position.

2. A side loading refuse truck according to claim 1 in which the shield is pivotally connected to the front edge of the ram and reciprocates therewith when said ram is reciprocated through the compartment and when said ram reciprocates through the receiving body.

3. A side loading refuse truck according to claim 1 in which there is a lost-motion connection between the ram and the shield and said shield is engaged by said lost-motion connection and pulled rearwardly by said ram only when said ram moves rearwardly beyond the intermediate position thereof.

4. A side loading refuse truck according to claim 1 in which the compartment, the receiving body, the hydraulic mechanism, including the ram, the shield and the guide are a unitary structure and are adapted for mounting as such on a truck chassis.

5. A side loading refuse truck body having a. a loading compartment, b. a larger refuse receiving chamber adjacent the compartment and rearwardly thereof, c. a floor for the compartment and a floor for the chamber that lie in the same horizontal plane, d. a partition between said compartment and said chamber defining an opening between the compartment and the chamber, e. a low profile ram movable along said floors for pushing refuse from the bottom of the loading compartment through such opening and into said receiving chamber, f. horizontal guides for said ram extending from forward of said loading compartment to the rear of said chamber for guiding said ram along said floor from a front position forward of said loading compartment to an intermediate position with its rear face closing such opening and to a rear position at the rear of said chamber for ejecting refuse therefrom, g. a shield comprising a plurality of articulated members and having a length sufficient to extend from the front of said compartment to the front of said ram when said ram is in its rear position, h. means connecting said ram to said shield for movement therewith when said ram is moved to its rear position, i. vertically extending shield guides at the front of said compartment for receiving said shield when said ram is at its front position, and j. hydraulic cylinder means connected between the front end of said body and said ram for reciprocating said ram through the bottom of said loading compartment and to and from the rear of said receiving chamber.

6. A refuse truck according to claim 5 and horizontal shield guides extending rearwardly from the loading compartment to the rear of the travel of the shield in the receiving chamber.

7. A refuse truck according to claim 5 and arcuate guide sections connecting the lower end of the horizontal shield guides to the vertically extending shield guides.

8. A refuse truck according to claim 5 in which the articulated shield is pivotally connected to the front upper edge of the ram and movable with said ram.

9. A refuse truck according to claim 5 in which the articulated shield comprises a horizontal sliding cover and there is a lost-motion connection between the ram and said cover, whereby said cover and said shield are engaged by said ram for rearward movement therewith only when said ram is moved rearwardly beyond the intermediate position thereof.

10. A refuse loading and transporting truck having a loading compartment at one end thereof, a larger refuse storage body adjacent such loading compartment, a floor of said loading compartment and a floor of said body lying in substantially the same plane, a partition extending downwardly to a level spaced above said floors and defining an opening from said loading compartment into said body and a ram having a closed rear face and a closed top that is mounted for reciprocatory movement across the bottom of said loading compartment for pushing refuse from said loading compartment through said opening, that is characterized by a. horizontal guides for said ram extending from forward of said loading compartment to the rear of said storage body for guiding said ram along said floors from a front position with the rear face of said ram closing said opening and to a rear position at the rear of said storage body for ejecting refuse therefrom, b. hydraulic mechanism for alternatively reciprocating said ram through said storage compartment and into, out of and through said storage body, c. a multi-part horizontal shield extending the width of said floors and including said top on said ram and having a total length sufficient to extend from the front of said compartment to the rear face of said ram when said ram is in its rear position to assist the ram in the unloading of refuse from said storage body, d. means coupling said shield parts to said ram for movement with said ram when said ram moves at least rearwardly of said partition, and e. shield guides extending from forward of said loading compartment to the rear of said storage body for storing said shield parts other than the top of said ram when said ram is at its front position and for guiding said other shield parts as said ram is moved between its position closing said opening in said partition and its rear position.

* * * * *